US006676475B1

(12) United States Patent
Henderson et al.

(10) Patent No.: US 6,676,475 B1
(45) Date of Patent: Jan. 13, 2004

(54) INFANT TOY AND GLIDER DEVICE

(76) Inventors: Scott Henderson, 6650 Bunker Hill Ct., San Jose, CA (US) 95120; Laurel Henderson, 6650 Bunker Hill Ct., San Jose, CA (US) 95120

( * ) Notice: Subject to any disclaimer, the term of this patent is extended or adjusted under 35 U.S.C. 154(b) by 9 days.

(21) Appl. No.: 10/440,287

(22) Filed: May 15, 2003

(51) Int. Cl.[7] ..... A63B 21/00
(52) U.S. Cl. ..... 446/227; 482/96; 5/108
(58) Field of Search ..... 482/92, 93, 95, 482/96, 78, 142; 5/108, 655; 446/227, 71

(56) References Cited

U.S. PATENT DOCUMENTS 1,996,350 A * 4/1935 Schaff ..... 482/96
3,622,154 A * 11/1971 Williams ..... 482/96
4,796,949 A 1/1989 Boyce ..... 297/259
5,035,233 A * 7/1991 Ruf ..... 601/27
5,242,338 A * 9/1993 Hartdegen et al. ..... 482/1
5,411,457 A * 5/1995 Hartdegen et al. ..... 482/96
5,765,913 A 6/1998 LaPointe et al. ..... 297/281
6,464,295 B1 10/2002 Bergeron et al. ..... 297/270.4

* cited by examiner

*Primary Examiner*—Jacob K. Ackun
(74) *Attorney, Agent, or Firm*—Thomas Schneck; David M. Schneck

(57) ABSTRACT

A toy for use by an infant in which the infant may set a top, suspended in pendulum fashion to a base, into motion. The top and base are joined by pendulum arms that cause a reciprocating gliding mechanism that is generally in the horizontal plane. The infant is positioned such that the infant may kick a pad joined to the fixed location base, initiating a force which propels the top to move back and forth providing entertainment and motor skills development.

19 Claims, 4 Drawing Sheets

INFANT TOY AND GLIDER DEVICE

TECHNICAL FIELD

This device relates generally to devices used by infants. More particularly the invention relates to a toy that allows an infant to propel a gliding device on which the infant rests.

BACKGROUND OF THE INVENTION

A number of alternative devices for infant exercise and entertainment have been marketed. Such devices include swings, saucers, activity gyms which position dangling objects within the reach of an infant, and walkers, among others. Such devices provide an infant with the opportunity to exercise, developing muscles and potentially learning coordination of muscle movement. Alternatively, such devices may produce a motion which is soothing to the infant.

One such invention is described in U.S. Pat. Nos. 5,242,338 and 5,411,457. These references disclose infant entertainment and development devices in which an infant holding bed surface may slide over a base surface. At one end of the base surface is a kick board. The infant is positioned such that the infant is able to kick the kick board, sliding the infant holding surface over the base surface. The base surface may be inclined such that the infant is pushing the infant holding surface up a slight incline. When such pushing force is relaxed, the infant holding surface would then slide back to a stop, finding its original position at the lower position of the incline. Ball bearings between the infant holding surface and the base may make the sliding easier. Straps may be used to secure an infant to the infant holding surface. Positive reinforcement signal generator may also be used to encourage infant use of the kick plate.

It is an object of our invention to provide a more energy efficient device which an infant may use to strengthen muscles and gain coordination of leg muscles.

It is a further object of the invention to provide a device which both allows an opportunity for entertaining an infant as well as providing a continuous soothing rocking motion for an infant.

SUMMARY OF THE INVENTION

The above objects are achieved in a toy using a gliding device operated by an infant. The term "gliding" used herein means back and forth reciprocating motion with deviation from the horizontal due to a pendulum suspension. A gliding mechanism produces motion governed by the pendulum principle, a back and forth motion that continues (with dampening) for a period of time. The device includes a stationary base with a bed top on top of the base. The bed top is attached to the base by a glider mechanism that links the base to the bed top. The glider mechanism may be a plurality of pivot arms affixed at a first end on each arm by a bearing assembly to the stationary base and affixed at a second end of the pivot arm to the bed top. If four such pivot arms are used on each of four corners of the stationary base, this would allow a back and forth gliding motion once the bed top is set in motion. Affixed to the base is an adjustable kick pad which extends from the base to an area over the bed top such that an infant would interact with this kick pad. When the infant exerts a force on the kick pad, the bed top is set in motion in a gliding arc. This gliding motion is often found entertaining to infants providing a built-in reinforcement of the kicking action. The kick pad may be padded and adjustable such that the kick pad may be brought closer to an infant or raised from the bed top as an infant grows larger. The bed top may include a pad permanently attached to the bed top or detachable via snaps, plastic hooks, or other attachment means. The bed top may also include straps allowing the infant to be secured over the bed top. A removable fitted sheet may also be used on the bed top. The straps would extend through holes on the fitted sheet. This sheet may then be washed when soiled.

DETAILED DESCRIPTION OF THE INVENTION

Figure 1:
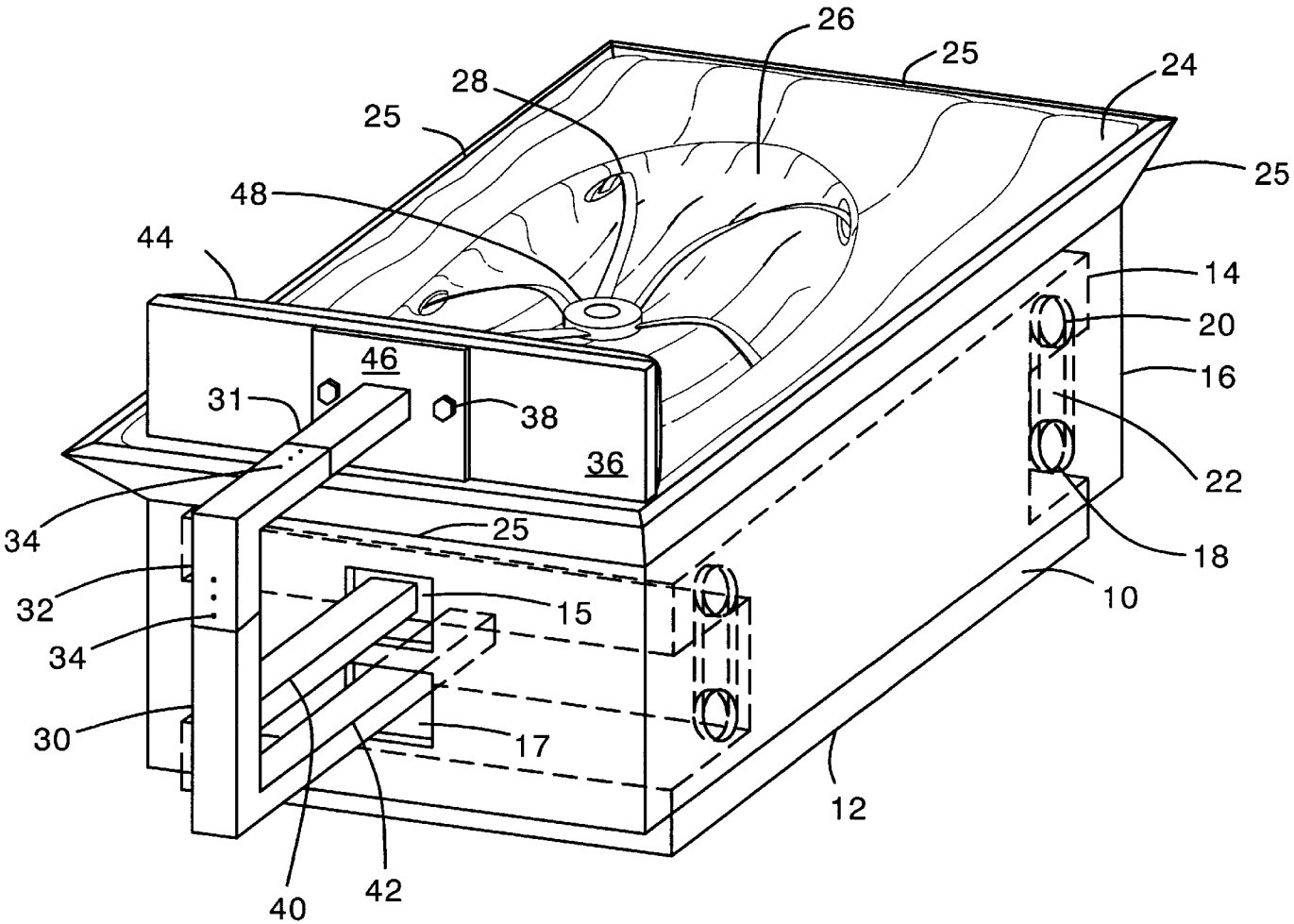
FIG. 1 is a perspective view of the infant propelled glider of the present invention.

With respect to FIG. 1, in the perspective view shown, one embodiment of the present invention includes a stationary base 10 joined to a bed top 16. The stationary base is I-shaped, having a base bottom 12 and a base top 14. The base bottom 12 may rest on any level surface such as a floor or counter table top.

Base 10 is attached to bed top 16 by a number of pivot arms 22. In the illustrated embodiment, four pivot arms are used at four corners of base 10. Pivot arms 22 are joined to base 10 by bearing assembly 20. Bearing assembly 20 is affixed onto base 10 such that arm 22 may swing back and forth on bearing assembly 20. At a lower portion of arm 22, bearing assembly 18 extends onto or through bed top 16. In this way, arm 22 is attached at one end to base 10 and a second end to bed top 16 such that arm 22 may pivot on either end. Once bed top 16 is set in motion, the bed top will continue to rock back and forth on arms 22, producing a gliding motion. Thus arms 22 constitute a glider mechanism or pendulum mechanism producing a back and forth pendulum motion.

The top of bed top 16 provides features to allow positioning of an infant. An inclined side 25 provides a top inside surface 24. In the center of top inside surface 24 is an infant holding recess 26. Extending over this area are straps 28 secured by clip 48. The infant is held in the depression created by recess 26 and secured in place by straps 28. Alternatively, pairs of straps connected by a clip or buckle may be used, or self-adhering straps may also be used. An infant positioned in recess 26 will be rocked by bed top 16 when bed top 16 is subjected to a gliding motion.

An infant kicks the kick pad 44 to apply force to pad 44 mounted on kick plate 36 which allows an infant to set bed top 16 into motion. The infant is positioned on bed top 16 such that the infant's legs are directed toward kick pad 44. Kick pad 44 is secured on one side of an elongate bar. The other side to which kick pad 44 is affixed is kick plate 36 secured by bolts 38 extending through plate 46 onto arm 31. This positions kick pad 44 within the reach of the legs of an infant held in recess 26. Kick pad 44 may be textured or contoured to provide a desired tactile surface. Bracket 32 attaches the arm 31 to arm 30 extending downward from kick plate 36. Lateral arms 40, 42 extend through holes 15, 17 respectively in bed top 16. Arms 40, 42 are attached to base 10 to securely anchor the structure of the kick pad into a fixed position. In other embodiments, a single arm extending from the base may be used. This arm may extend from the area of the base close to the surface on which the base rests.

Bracket 32 includes adjustment pins 34 or other adjusters. The pins may be removed and bracket 32 adjusted to move kick pad 44 up or down relative to bed top 16 or to move kick pad 44 closer to or farther from the legs of an infant (i.e. have the pad 44 extend further or less far into bed top 16). When an infant kicks kick pad 44, bed top 16 is moved in a gliding motion. Infants generally respond positively to such gliding motions. The gliding motion caused by the infant kicking the kick pad provides an automatic reinforcement to the infant to encourage subsequent targeting of the kick pad to produce the rocking motion.

Figure 2:
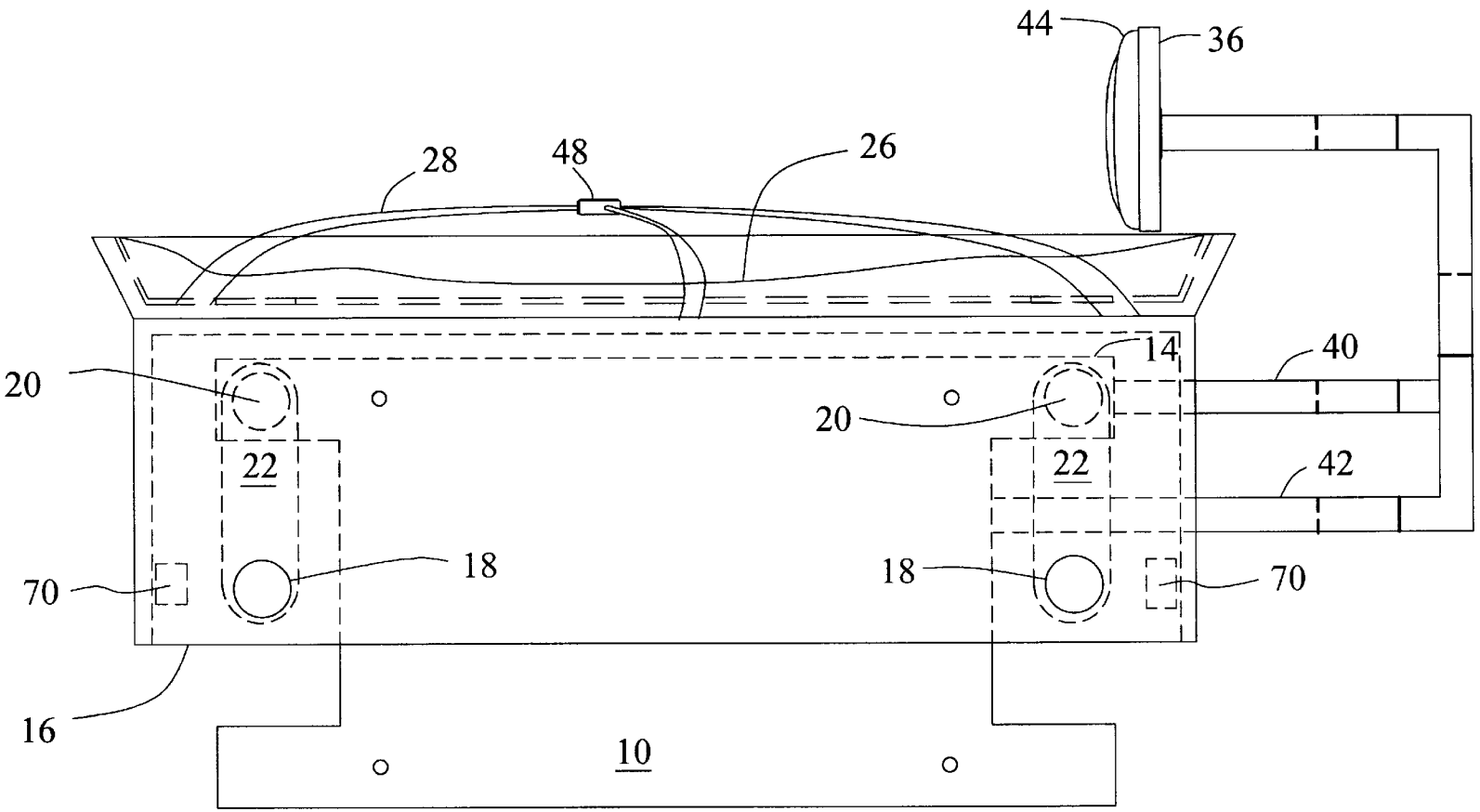
FIG. 2 is a side view of the device of FIG. 1 with the device at rest.
Figure 3:
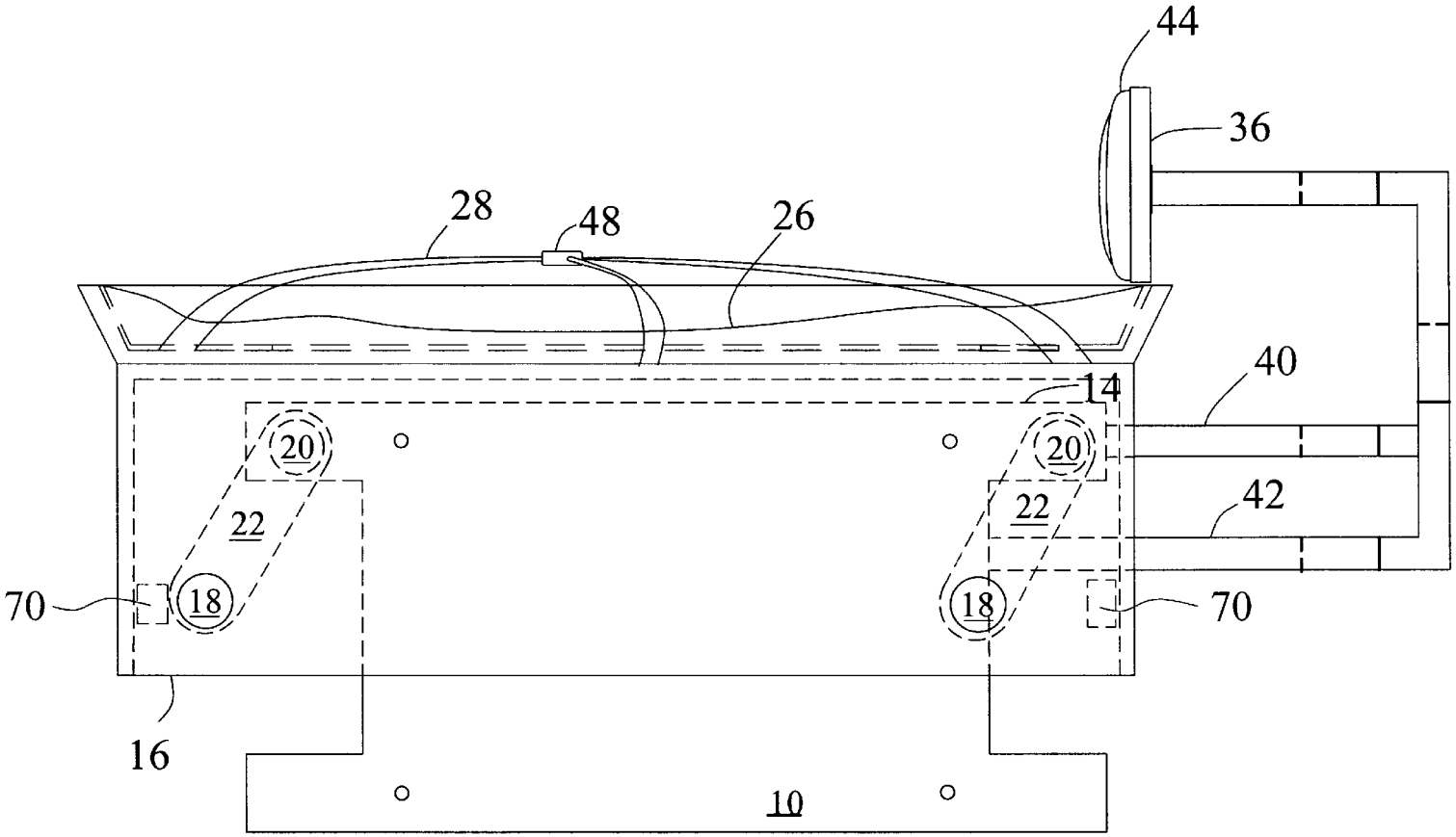
FIG. 3 is a view of the device of FIG. 2 with the bed top moved with respect to the stationary base.

FIGS. 2 and 3 illustrate the motion of the bed top 16 of the present device. As shown in FIG. 2, bed top 16 is secured onto base 10 by pivot arms 22. Pivot arms 22 are secured at a first end to the base by bearing assembly 20 and at a second end to the bed top by bearing assembly 18. Arms 40, 42 extend from base 10 securing kick plate 36 to base 10. At rest the pivot arms 22 are not angled. Facing into the crib mounted on kick plate 36 is kick pad 44. The kick pad 44 may be textured to provide a frictional surface. An infant positioned within a contoured, body-shaped recess 26 and secured by straps 28 fastened by clip 48 may be positioned such that the infant's legs are pointed in the direction of kick pad 44. The infant is at a fixed location on bed top 16 secured by straps 28. When the infant kicks onto kick pad 44, pivot arms 22 pivot on bearing assemblies 18, 20 rocking bed top 16 in a glider motion. Stop 70 limits the range of motion of arm 22. Stop 70 may be a rubber bumper, a metal spring or other similar device. This is shown in FIG. 3 where pivot arms 22 are shown angled. Once the bed top 16 is set in motion, pendulum momentum in the suspension will cause continued rocking in a gliding motion for a period of time. This motion is often pleasing or soothing to an infant.

Figure 4:
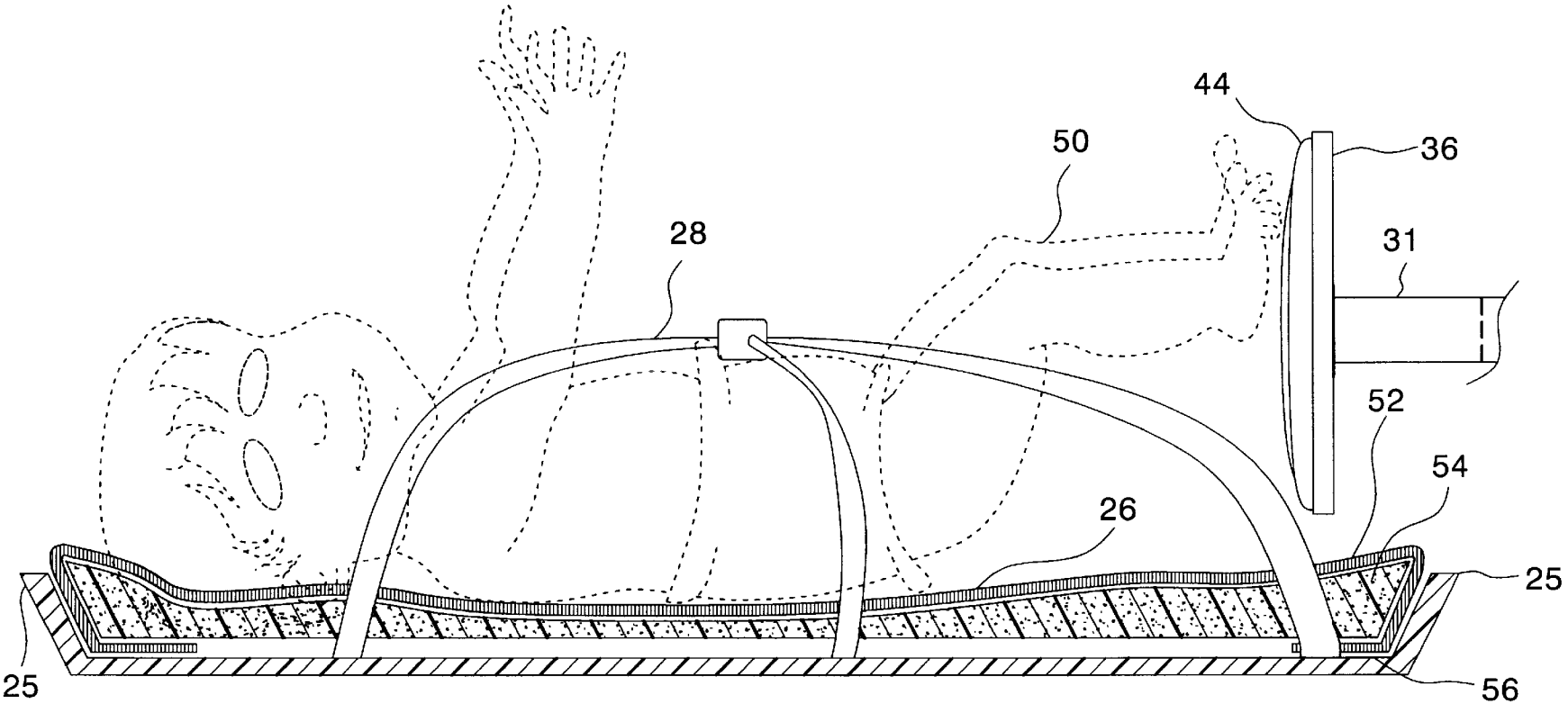
FIG. 4 is a partial side cut-away illustrating an infant on the bed top portion of the present device.

The cross-sectional view of FIG. 4 illustrates the various layers of the infant recess area 26. A hard plastic bottom surface 56 forms the base of the recess extending between sides 25. Mounted over this surface is a foam pad with vinyl covering 54. This pad is waterproof or water resistant allowing spills to be easily wiped up and removed. This pad may be affixed with adhesive or attached using snaps, hooks, or other fasteners. Sheet 52 is fitted over pad 54. Sheet 52 may have a plurality of holes at the sides of the sheet to allow straps to be inserted through the sheet. An infant 50 positioned within recess 26 is positioned such that the infant is held by straps 28 and may apply foot pressure to kick pad 44 mounted on kick plate 36 held by arm 31. Arm 31 is connected to the base as described in FIGS. 1, 2, and 3.

A number of different gliding mechanisms may be adopted. Various known glider mechanisms are disclosed in U.S. Pat. Nos. 4,796,949; 5,765,913; and 6,464,295. All references mentioned in this patent application are hereby incorporated by reference herein in their entirety.

The "kick and glide" device disclosed herein may include a number of additional features. One skilled in the art will realize that it would be very simple to mount instrumentation for measuring or counting the gliding motion. During times when it is desired not to use the gliding feature of the present invention, a lock could be inserted such that bed top 16 remains stationary. In its simplest form such a lock could be a pin inserted through the sides of bed top 16 and inserted into base 10. Such a lock would allow the bed top 16 to remain stationary if desired. Base 10 may include wheels allowing the device to be transported to a new location. Such wheels could be retractable or could include a lock to prevent the wheels from rotating making the device stationary. A cover sheet used on the bed top could extend over kick pad 44. Such a cover would present the infant a kick target while preventing the legs of a smaller infant from getting between kick pad 44 and bed top 16. Such a sheet may be secured to bed top 16 and includes some elasticity to allow for the gliding mechanism. Bed top 16 could have a flat top surface, allowing a parent to put a changing pad or other similar device on the flat surface. This changing pad would hold the infant on the glider. The pad would need to be secured onto the flat surface of bed top 16. Besides providing entertainment, the present invention is a development apparatus that is appropriate for a baby from only a few weeks old to several months old. The ability to adjust the kick pad allows the device to be adjusted to the increasing size of the baby during a period of the baby's growth. In addition, arms 30, 34 being adjustable, arms 40, 42 could also be adjustable in length.

What is claimed is:

1. A glider device that may be put into motion by infant kicking, the device comprising:

a stationary base;

a bed top;

a pendulum mechanism linking said base and said bed top, said pendulum mechanism allowing said bed top to move in a reciprocating gliding motion relative to said base; and a kick pad attached to said base and extending over said bed top such that force applied by an infant positioned on said bed top to said kick pad causes said bed top to move on said pendulum mechanism in a gliding motion.

2. The device of claim 1, wherein said pendulum mechanism includes a plurality of pivot arms connecting said bed top to said base.

3. The device of claim 1, further including an adjustment bracket between said kick pad and said base, said adjustment bracket allowing positional adjustment of kick pad location.

4. The device of claim 1, wherein said bed top includes a water proof pad secured to said bed top, said pad contoured to hold an infant.

5. The device of claim 1, wherein said bed top includes straps to hold an infant.

6. The device of claim 5, wherein said bed top includes a sheet, said sheet having holes through which said straps may be inserted.

7. A glider device that may be put into motion by infant kicking, the device comprising:

a stationary base having an I-shaped cross-section;

a bed top;

a plurality of pivot arms linking said base and said bed top, said arms suspending said bed top to move in a pendulum motion relative to said base, thereby producing a reciprocating gliding motion;

a kick plate arm extending from said base to a location over said bed top; and a kick pad attached to said arm, whereby force applied by an infant positioned on said bed top to said kick pad causes said bed top to move on said pivot arms in a reciprocating gliding motion.

8. The device of claim 7, wherein said pivot arms are linked to said base and said bed top by bearing assemblies.

9. The device of claim 7, further including an adjustment bracket on said kick plate arm said adjustment bracket allowing positional adjustment of kick pad location.

10. The device of claim 7, wherein said bed top includes a water proof pad secured to said bed top, said pad contoured to hold an infant.

11. The device of claim 7, wherein said bed top includes straps to hold an infant.

12. The device of claim 11, wherein said bed top includes a sheet, said sheet having holes through which said straps may be inserted.

13. A glider device that may be put into motion by infant kicking, the device comprising:

a base means;

a means for holding an infant;

a mechanical means joining the base means to the means for holding an infant, said mechanical means allowing said bed top to move in a reciprocating pendulum motion relative to said base means; and an infant activated means for setting said means for holding said infant into a gliding motion.

14. The device of claim 13, wherein said means for holding an infant includes a pad contoured to hold an infant.

15. The device of claim 14, wherein said pad is removable.

16. The device of claim 13, wherein said means for holding an infant includes straps to hold the infant.

17. The device of claim 14, wherein said means for holding an infant includes a sheet, said sheet fitting over said pad.

18. The device of claim 13, wherein said mechanical means includes a plurality of pivot arms connecting said base means with the means for holding an infant.

19. The device of claim 13, wherein said infant activated motion means includes an adjustment means allowing adjustment of location of said infant activated motion means relative to the means for holding an infant.

* * * * *